US006447427B1

(12) United States Patent
Myrland et al.

(10) Patent No.: US 6,447,427 B1
(45) Date of Patent: Sep. 10, 2002

(54) AGILITY TRAINING LADDER

(75) Inventors: Steven S. Myrland, Middleton; James W. Myrland, Verona, both of WI (US)

(73) Assignee: Myrland Sports Training LLC, Middleton, WI (US)

( * ) Notice: Subject to any disclaimer, the term of this patent is extended or adjusted under 35 U.S.C. 154(b) by 0 days.

(21) Appl. No.: 09/422,618

(22) Filed: Oct. 21, 1999

Related U.S. Application Data

(60) Provisional application No. 60/105,513, filed on Oct. 23, 1998.

(51) Int. Cl.[7] ..... A63B 7/08; A63B 4/00

(52) U.S. Cl. ..... 482/34; 482/14; 482/15

(58) Field of Search ..... 482/33–35, 52, 482/14, 15, 16, 17; 182/49, 33, 27, 93, 120, 107, 156; 446/475; 239/286; 238/279; 473/440; 273/26 R, 55

(56) References Cited

U.S. PATENT DOCUMENTS 656,732 A * 8/1900 Scott
4,646,878 A * 3/1987 Moyer ..... 182/121

OTHER PUBLICATIONS

Power Systems Agility Ladder, 1998 Catalog, p. 19.*
Agility Ladder, *Power Systems* 1998 Fall/Winter Product Catalog, p. 19.

Agility Ladder, *Power Systems* 1999 Fall–Winter Product Catalog, p. 17.

Power Stride Ladder™, *Power Systems* 2000 Fall Winter Product Catalog, p. 16.

Agility Ladder, *Power Systems* 2000 Fall Winter Product Catalog, p. 17.

Kytec Speed Foot Ladder, Kytec Athletic Speed Equipment, p. 8.

* cited by examiner

*Primary Examiner*—Michael A. Brown
*Assistant Examiner*—Lori Baker Amerson
(74) *Attorney, Agent, or Firm*—Craig A. Fieschko, Esq.; DeWitt Ross & Stevens S.C.

(57) ABSTRACT

An agility ladder for athletic training and exercise use is shown and described. The ladder has at least two elongated parallel railings spaced by rungs extending between the railings. The railings are preferably flexible so that they may be folded to collect the rungs into a stacked or bundled configuration. The collected rungs may then be mounted on an elongated handle for storage purposes. The rungs are slidably mounted on the railings so that they may be repositioned thereon, but a locking arrangement is also provided to allow the rungs to be firmly fixed in place on the railings.

33 Claims, 2 Drawing Sheets

AGILITY TRAINING LADDER

CROSS-REFERENCE TO RELATED APPLICATIONS

This application claims priority under 35 USC §119(e) to U.S. Provisional Patent Application 60/105,513 filed Oct. 23, 1998, the entirety of which is incorporated by reference herein.

FIELD OF THE INVENTION

This disclosure concerns an invention relating generally to exercise equipment, and more specifically to equipment for assisting in the improvement of athletic agility, balance, coordination, foot speed, and functional movement mechanics.

BACKGROUND OF THE INVENTION

Agility ladders are athletic training/exercise equipment used to improve speed and agility. They are configured similarly to common ladders wherein rungs are spaced between opposing sets of rails, and are laid out on the ground so that the apertures between the rungs and rails of the ladder define a series of spaces in which an athlete is to step. Different ladder training drills emphasize different rhythms or patterns of steps, jumps, hops, bounds, or combinations of these elements to teach control of the athlete's center of gravity while in motion, and to improve the athlete's foot speed and reaction time.

There are two known prior agility ladders. A first prior ladder uses nylon webbing to form both the ladder rails and rungs. The second prior ladder uses nylon webbing to form the rails, and hollow plastic tubing is used for rungs. Both ladders may have their railings folded with their rungs gathered together to collect the ladders for storage purposes. However, they have been found to be highly inconvenient to use insofar as they become twisted and tangled when they are folded for storage, and during later unfolding for use. Additionally, the prior ladders have been found to be easily dislodged during use if a user kicks or steps on a rung or railing, thereby requiring that the ladder be frequently reoriented during use. The ladder made entirely of webbing is too easily dislodged and tangled during use, while the ladder made with round plastic tubular rungs presents a safety problem since the round rungs can easily roll underfoot when stepped on during use.

SUMMARY OF THE INVENTION

The invention, which is defined by the claims set forth at the end of this document, is an agility ladder having at least two elongated parallel railings spaced by rungs extending between the railings. The railings are preferably formed of strips of nylon or other fabric material so that they may be easily folded, whereas the rungs are preferably made of a rigid material, such as plastic. The rungs are preferably provided in a substantially planar, bar-like form and are affixed to the railings in such a manner that both the rungs and railings rest substantially flat against the ground when the agility latter is placed in use. The heavier bar-like rungs serve as high-friction weights which help protect the flexible railings from being dislodged when the agility ladder is in use, particularly when the rungs have greater surface area on their major sides, and/or when the rungs have textured surfaces or are rubberized for higher friction.

The rungs are preferably affixed on the railings by inserting each railing within one or more railing apertures formed in each rung, thereby allowing the rungs to be slidably relocated along the railings to vary their spacing. It has been found that where each railing is woven through a pair of railing apertures in each rung, the rungs are resistant to accidental dislodgement or displacement along the railings, but they are still easily relocated along the railings when desired (for example, to change from lateral speed and agility work to straight-ahead acceleration training where athletes must learn to begin with short strides and progress to longer strides as they gain momentum). However, to allow a user to firmly fix the rungs with respect to the railings, locking means for fixing the rungs to the railings may be provided. As an example, a locking aperture may be provided in each rung adjacent to each of the railing apertures. The railing may be situated over the locking aperture, and then a pin or other locking member may be inserted into the locking aperture so that the railing is firmly gripped between the locking member and the rung.

In particularly preferred versions of the agility ladder, the ladder is provided in combination with a handle having an elongated handle shaft protruding therefrom, and the rungs have handle apertures defined therein so that adjacent rungs can be successively received on the handle shaft. A lock may then be provided on the handle shaft to prevent the rungs from sliding off the shaft once they are received thereon; for example, the lock may be provided in the form of a pin which is removably received within an aperture defined on the handle shaft. The handle is preferably configured in the shape of a U, with the handle shaft forming one arm of the U and a grip section forming the other arm of the U, so that a user may grasp the grip section of the handle with one hand while using the other hand to collect rungs on the handle shaft.

The agility ladder preferably bears fasteners (such as male and female snap connectors) located along the lengths of its railings so that multiple agility ladders can be affixed together in various configurations (e.g., in straight lines, at right angles to each other, or in even more complex paths).

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
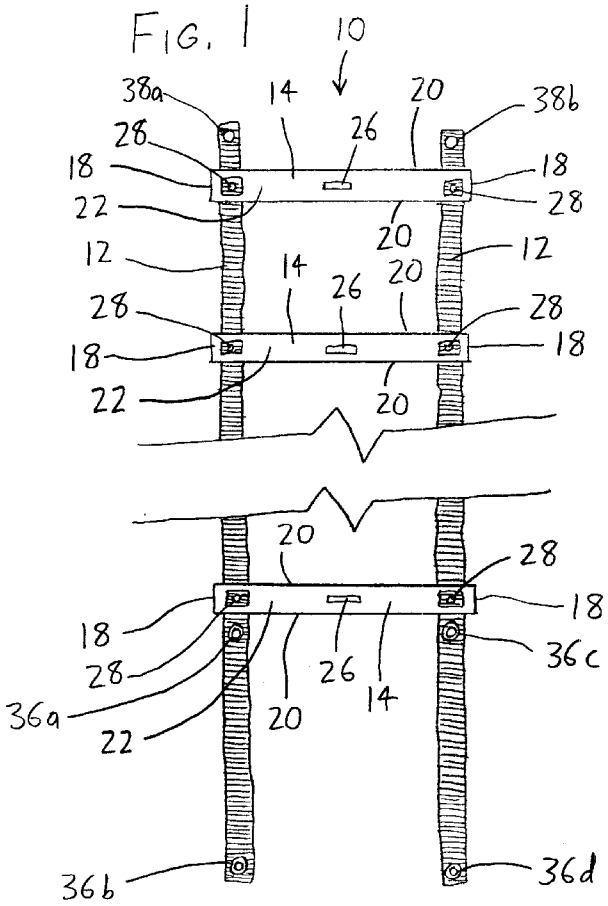
FIG. 1 is a partial top view of a preferred version of the agility ladder.
Figure 2:
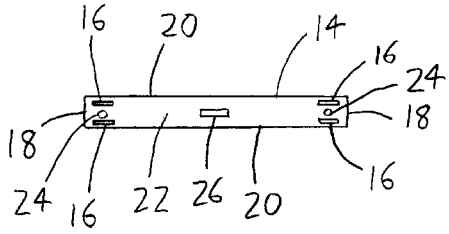
FIG. 2 is a top view of a rung of the agility ladder of FIG. 1.
Figure 3:
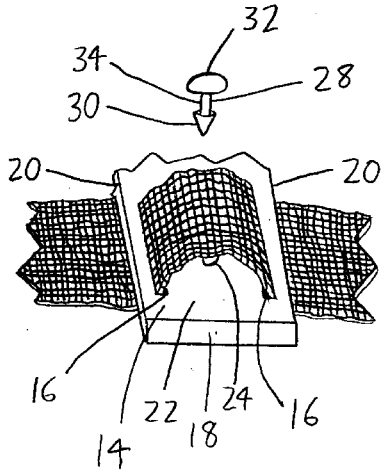
FIG. 3 is a partial perspective view of a railing 12 and rung 14 of the agility ladder of FIG. 1, illustrating the attachment arrangement between the railing and rung.
Figure 4:
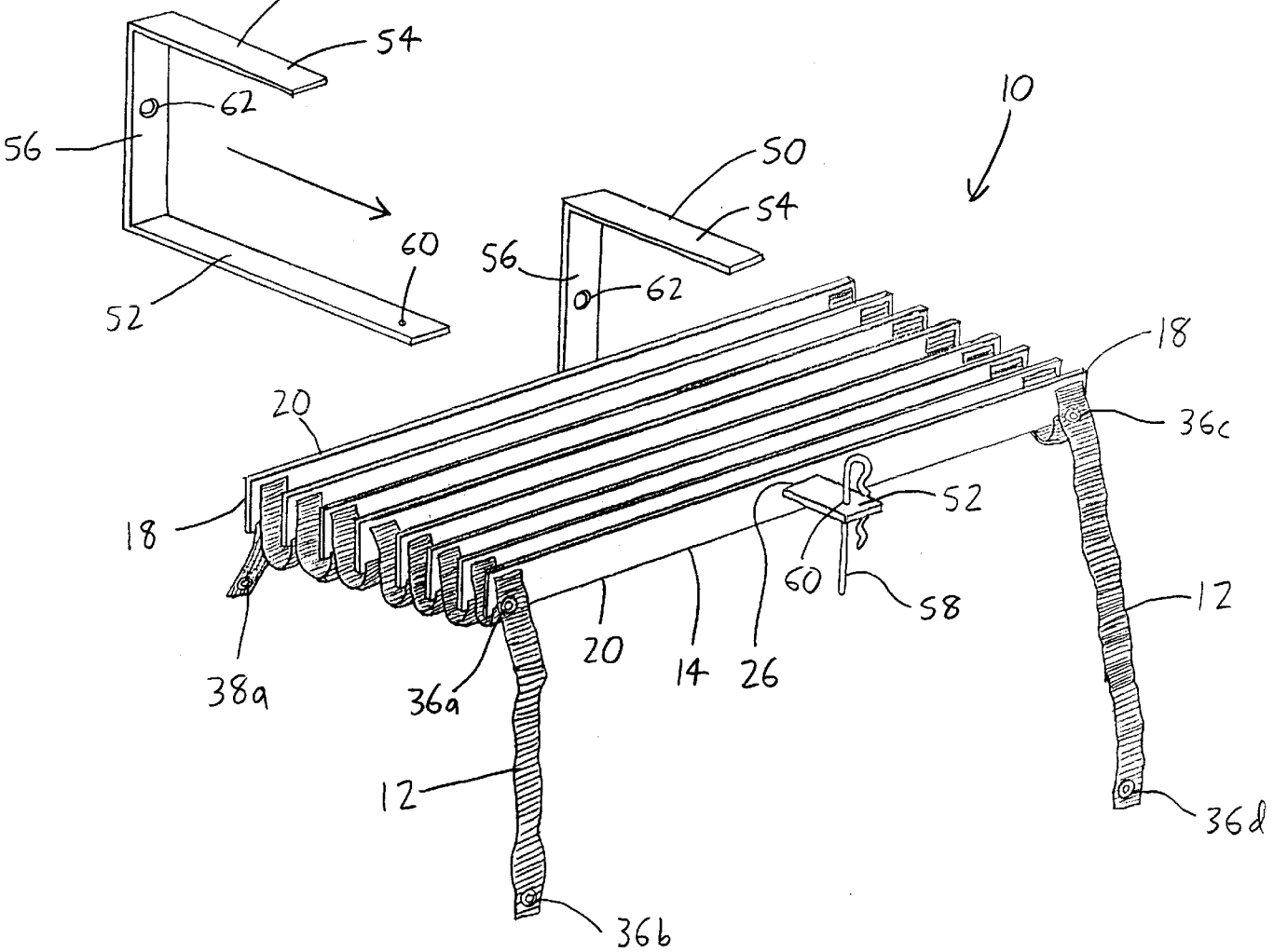
FIG. 4 is a perspective view of the agility ladder of FIG. 1 shown folded (collapsed) and collected on a carrying handle.

In the drawings, wherein the same or similar features of the invention are designated in all figures with the same reference numerals, FIGS. 1–4 illustrate a preferred version of the agility ladder. Referring first to FIG. 1, the agility ladder is shown at 10 in extended form. The agility ladder 10 includes two elongated parallel railings 12 with rungs 14 extending between the railings 12 in spaced relation, whereby the apertures defined between the rungs 14 and railings 12 define areas wherein an athlete is to step. The railings 12 are preferably formed of flexible but substantially inelastic flat nylon webbing, whereas the rungs 14 are preferably formed of substantially planar beams formed of plastic or other rigid materials. As will be discussed later, the flexibility of the railings 12 (and the rigidity of the rungs 14) allows the rungs to be folded into a stacked compact array as illustrated in FIG. 4. The rungs 14 are preferably joined to the railings 12 in such a manner that when the agility ladder 10 is fully extended (as in FIG. 1), it rests in a substantially planar condition flat against the ground. The flat configuration of the ladder 10 helps to maintain it close against the ground to minimize the possibility that an athlete will trip over the rungs 14 or railings 12. Additionally, flat rungs 14 have higher friction against the ground (particularly if textured or rubberized), and do not roll when they are stepped upon (as tubular rungs are prone to do).

The preferred attachment arrangement between the railings 12 and rungs 14 may be better understood with reference to FIGS. 2 and 3. Initially referring to FIG. 2, wherein a rung 14 is shown without railings 12, the rung 14 includes a pair of slot-like railing apertures 16 at each of its longitudinal sides 18, with the railing apertures 16 being spaced apart between the rungs' lateral sides 20. The railing apertures 16 extend between the top surface 22 of the rung 14 and its bottom surface (not shown). A locking aperture 24 is then formed between the separate railing apertures 16 at the longitudinal sides 18 of the rungs 14, with the locking aperture 24 also extending between the top surface 22 of the rung 14 and its bottom surface. The function of the locking aperture 24 will be discussed later. Similarly, a slot-like handle aperture 26 is also formed between the top surface 22 and bottom surface of the rung 14 approximately midway between the longitudinal sides 18 of the rung 14, and its purpose will be discussed later as well.

Turning now to FIG. 3, each rung 14 is attached to a railing 12 by extending the railing 12 from the bottom surface of the rung 14 upwardly through one of the railing apertures 16, over the top surface 22 (and locking aperture 24) of the rung 14, and then downwardly through the other railing aperture 16 to extend outwardly from the bottom surface of the rung 14. In effect, the railing 12 is "woven" through the railing aperture 16 in the rung 14 to cover its locking aperture 24. In FIG. 3, the railing 12 is shown with slack between the railing 12 and the top surface 22 of the rung 14; this is merely done to provide a view of the locking aperture 24, and it should be understood that in practice, the railing 12 will be pulled closely against the top surface 22 of the rung 14. By weaving the railing 12 through the rung 14 in this manner, the rung 14 tends to remain in a set position on the rung 14, though the rung 14 may be slidably relocated on the railing 12 with minor effort.

A locking means is then provided for more fly affixing the rungs 14 to the railing 12 when desired. The locking means may be provided in the form of a locking member which may be set atop the railing 12 (with the railing 12 resting between the locking member and the rung 14), and which may then be pushed into the aforementioned locking aperture 24 to sandwich the railing 12 between the locking member and the rung 14, firmly grasping it therebetween. The locking member illustrated in FIG. 3 is a pin 28 having a sharpened enlarged tip 30 spaced from a wide pin head 32 by a narrow pin body 34. The pin 28 can be extended through the railing 12 to extend into the locking aperture 24, with the pin tip 30 piercing railing 12 and extending through the locking aperture 24 so that the railing 12 is clamped between the pin tip 30 and the rung 14 (with the pin tip 30 hindering withdrawal of the pin 28 from the locking aperture 24 once fully inserted). If the pin 28 is long enough, at the bottom surface of the rung 14 (not shown in the Figures), the pin tip 30 may extend away from the bottom surface of the rung 14 to effectively form a spike which engages the ground beneath the agility ladder 10 (which may be desirable in the case where grass or similar soft surface is used). Alternatively, the pin 28 may be shorter and the bottom surface of the rung 14 may be recessed about the locking aperture 24 so that the pin tip 30 does not extend beyond the bottom surface of the rung 14. This configuration is more desirable where the ladder 10 is to be used on smooth hard surfaces, such as on a gymnasium floor or on pavement.

As previously noted, the pin 28 need not be used and the railings 12 may simply be slidably fit within the railing apertures 16 of the rungs 14. While the rungs 14 will be resistant to sliding on the railings 12, the use of the pin 28 will help to more firmly affix the rungs 14 in a desired position and make them more highly resistant to displacement (e.g., in the event that an athlete forcibly kicks a rung 14).

With reference to FIG. 4, the agility ladder 10 is shown in folded/collapsed form in conjunction with a preferred handle 50. The handle 50 has a generally U-shaped configuration including an elongated insertion shaft 52, an elongated grip section 54 extending substantially parallel to the insertion shaft 52, and a bridge portion 56 extending between the insertion shaft 52 and grip section 54. The insertion shaft 52, which is preferably formed as a rectangular bar, is inserted within the slot-like handle apertures 26 within the rungs 14 in a manner shown in FIG. 4. Thus, when one wishes to convert the agility ladder from its extended "in-use" form of FIG. 1 to the collapsed "storage" form of FIG. 4, the user simply picks up successive rungs 14 and installs them on the handle 50 until all rungs 14 are received on the insertion shaft 52 (as in FIG. 4). The complementary configuration of the bar-like insertion shaft 52 and the slot-like handle apertures 26 maintains the rungs 14 in parallel aligned relation, though other configurations could be used as well.

A lock may then be provided on the handle 50 to prevent the rungs 14 from sliding off the insertion shaft 52; in FIG. 4, this lock is provided in the form of a kinked spring pin 58 which inserts within a lock aperture 60 situated near the end of the insertion shaft 52. The U-shaped configuration of the handle 50 allows one to readily grasp the grip section 54 of the handle 50 in one hand while collecting the rungs 14 on the insertion shaft 52 with the other hand. If desired, a lock storage aperture 62 may be provided on the bridge portion 56 (or the grip section 54) to store the spring pin 58 after the agility ladder 10 has been removed from the handle 50, so that the insertion shaft 52 will be left in a ready-to-load state.

The agility ladder 10 preferably has a number of fasteners situated along the railings 12 so that multiple agility ladders 10 may be affixed together in varying configurations, e.g., along a straight line, at right angles to each other, etc. The preferred fastener arrangement is shown in FIGS. 1 and 4. The railings 12 at one end of the agility ladder 10 extend outwardly from the final rung 14 by a length substantially equal to the width of the agility ladder 10 (i.e., by a length substantially equal to the distance between the longitudinal sides 18 of a rung 14), and preferably bear male snap connectors 36*a*, 36*b*, 36*c*, and 36*d* (collectively referred to as connectors 36) thereon. At the other end of the agility ladder 10, the railings 12 protrude outwardly only a slight distance beyond the final rung 14, and bear female snap connectors 38*a* and 38*b* (collectively referred to as connectors 38) thereon. This arrangement allows for a wide variety of attachment arrangements between multiple agility ladders 10; for example, the connectors 38 of one ladder may be respectively connected to connectors 36*a*/36*b* of another ladder, or to connectors 36*c*/36*d* of another ladder, so that one agility ladder 10 extends at a right angle to the other agility ladder. Alternatively, the connectors 38 of one ladder may alternatively be affixed to 36*a*/36*c* or to 36*b*/36*d* of another ladder so that the two agility ladders extend in a straight line. As another example, three agility ladders may be affixed in a T-configuration by affixing the connectors 38 of a second agility ladder to connectors 36*c*/36*d* on a first agility ladder, and the connectors 38 of a third agility ladder to connectors 38*a*/38*b* on the first ladder.

It is understood that a preferred version of the agility ladder is shown and described above to illustrate possible features of the invention. Apart from combining the different features of the preferred ladder in varying ways, other modifications are also considered to be within the scope of the invention. Following is an exemplary list of such modifications.

First, while the railings 12 and rungs 14 could be formed of elastic materials, inelastic materials are preferred because these help maintain the railings 12 and rungs 14 in a desired configuration set by a user. They are additionally more resistant to tangling, and are also resistant to permanent deformation when the ladder 10 is subject to extended periods of use. If it is desired to provide the ladder 10 with an elastic response, i.e., to allow it to "snap back" if it is kicked, a preferred approach is to connect elastic leads to the ends of the railings 12, pull them taut, and then stake these to the ground (or otherwise anchor them). If the elastic leads are attached to the railings 12 by use of the snap connectors 36/38, this beneficially has the effect of providing the ladder 10 with an elastic response, but it also allows the ladder 10 to break away from its anchoring if it is subjected to extreme force; the connectors 36/38 simply unsnap, and can be easily reconnected when desired.

Second, other forms of locking means for affixing the rungs 14 to the railings 12 may be used. The preferred locking means was previously described as a locking member (e.g., pin 28) which fits within a locking aperture (e.g., circular locking aperture 24) to grasp the railing 12 between the locking member and locking aperture. While the pin 28 pierces the railing 12 as well as pressing it against the rung 14, it should be noted that the pin 28 or other locking member need not necessarily pierce the railing 12, and it can instead simply be pressed into the locking aperture to force-fit the railing 12 within the locking aperture and between the locking member and locking aperture. Further, the locking member and locking aperture may be differently configured than the circular pin 28 and locking aperture 24 shown in the Figures; for example, the locking member may be a circular peg which fits into a circular locking aperture, a square peg which fits into a square locking aperture, a series of teeth engaging a complementary array of locking apertures, etc.

Third, other types of fasteners apart from snap connectors may be used to affix multiple agility ladders 10 together, such as buckles, hook-and-loop fasteners, jawed clasps/clamps (which may be spring-loaded or toothed for better gripping ability), or other forms of fasteners known to the art. The snap connectors 36/38 previously discussed are particularly preferred because they are exceptionally easy to operate, they provide firm attachment between separate agility ladders 10, and their structure does not interfere with the folding of the railings 12.

Fourth, a wide variety of handles having configurations different from the handle 50 are possible. It is noted that the insertion shaft of 52 of the handle 50 may be appropriately sized to accommodate several agility ladders 10 thereon, e.g., when the agility ladders 10 are affixed together along a straight line.

Fifth, more than two railings may be utilized; for example, rather than using two railings to provide a single lane of stepping areas (each area being defined between a pair of rungs), three railings may be used to define two lanes of stepping areas. More than three railings may also be used.

Sixth, the rungs and/or railings may be colored so that different stepping areas are bounded by different colors. This allows a trainer to call off different colors (i.e., desired stepping areas) during ladder training to change the nature of the drill. The use of differently-colored stepping areas may be particularly desirable where multiple lanes are present, since this arrangement allows great variety in the different types of drills that may be executed.

Seventh, it should be understood that a different number of railing apertures 16 may be used to slidably accommodate the railings 12 within the rungs. It is possible to have only a single railing aperture 16 at each of the longitudinal sides 18 of the rungs 14; for example, a railing aperture 16 might be provided at each longitudinal side 18, and could extend within the plane of the rung 14 rather than from its top surface 22 to its bottom surface. As another example, each railing 12 might be woven through three or more railing apertures 16 provided at a longitudinal side 18 of each rung 14. In general, the resistance of the rungs 14 to sliding on the railings 12 will increase when the railings 12 are woven through more railing apertures 16 (though this will partially depend on the configuration of the railing apertures 16).

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. An agility ladder comprising:

a. at least two elongated parallel railings, each railing being sufficiently flexible to allow it to fold;

b. rungs extending between the railings, each rung being at least substantially rigid and having a substantially planar configurational oriented in a plane substantially parallel to the railings, wherein each rung bears a handle slot therein, the handle slot being spaced distantly from the railings, whereby a bar-like handle may be inserted through the handle slots of the rungs to collect the rungs on the handle.

2. The agility ladder of claim 1 in combination with a handle having an elongated shaft, wherein the handle is configured for insertion through the handle slots of the rungs.

3. The agility ladder of claim 2 further comprising a lock adapted to engage the shaft, thereby preventing rungs from sliding on the shaft past the lock.

4. The agility ladder of claim 3 wherein the shaft includes a lock aperture wherein the lock is removably inserted.

5. The agility ladder of claim 2 wherein the handle includes an elongated grip section extending substantially parallel to the shaft.

6. The agility ladder of claim 5 wherein the handle includes an elongated bridge portion extending between the grip section and the shaft, with the bridge portion being oriented at a non-parallel angle to both the bridge portion and the shaft.

7. The agility ladder of claim 6 wherein the handle is configured in a U-shape.

8. The agility ladder of claim 1 wherein each railing is received within at least one railing aperture formed in each rung, whereby the rungs may be slidably relocated on the railings by moving the railings through the railing apertures.

9. The agility ladder of claim 8 wherein each railing is received within first and second railing apertures formed in each rung, the first and second railing apertures extending between a bottom side and a top side of each rung, with each railing extending into the first railing aperture in each rung at the bottom side of that rung, then extending over the top side of that rung between its railing apertures, and then through the second railing aperture of that rung to exit that rung's bottom side.

10. The agility ladder of claim 8 wherein each rung includes a locking aperture formed therein adjacent to each railing aperture, and wherein the agility ladder further comprises locking members insertable into the locking apertures, whereby the railings may be situated between the locking members and the locking apertures so that insertion of the locking members within the locking apertures affixes the railings to the rungs.

11. The agility ladder of claim 10 wherein the locking members are pins.

12. The agility ladder of claim 11 wherein the pins have enlarged heads sized substantially similarly to the locking apertures, whereby the insertion of the pins within the locking apertures snap-fits them therein.

13. The agility ladder of claim 1 wherein the railings extend between opposing railing ends having fasteners thereupon, whereby multiple agility ladders may be combined by attaching their railings together at the fasteners.

14. The agility ladder of claim 13 wherein the railings include multiple fasteners spaced along their lengths.

15. The agility ladder of claim 13 wherein the fasteners are snap connectors.

16. An agility ladder comprising:

a. at least two elongated parallel railings, each railing beg flexible and substantially inelastic;

b. substantially rigid rungs extending between the railings, each rung:

(1) having a substantially planar configuration and being oriented in a plane substantially parallel to the railings;

(2) having railing apertures defined therein, wherein the railings are slidably fit within the railing apertures;

(3) having locking apertures defined therein, each locking aperture being situated adjacent to a railing aperture, and wherein each railing at least partially extends into a locking aperture;

c. locking members sized to be received within the locking apertures, wherein the locking members may be removably inserted within the locking apertures to fix the railings with respect to the rungs.

17. An agility ladder comprising:

a. at least two elongated parallel railings, each railing being sufficiently flexible to allow it to fold;

b. rungs extending between the railings, each rung being at least substantially planar and being oriented in a plane at least substantially parallel to the railings, wherein each railing is received within at least one railing aperture formed in each rung, whereby the rungs may be slidably relocated on the railings by moving the railings through the railing apertures.

18. The agility ladder of claim 17 wherein each each rung bears a handle aperture therein, whereby an elongated handle may be inserted through the handle apertures of the rungs to collect the rungs on the handle.

19. The agility ladder of claim 18 wherein each handle aperture is spaced distantly from the railings.

20. The agility ladder of claim 18 in combination with a handle having an elongated shaft configured for insertion through the handle apertures of the rungs.

21. The agility ladder of claim 20 further comprising a lock adapted to engage the handle shaft, thereby preventing rungs from sliding on the handle shaft past the lock.

22. The agility ladder of claim 20 wherein the handle includes an elongated grip section spaced from and extending substantially parallel to the handle shaft.

23. The agility ladder of claim 17 wherein:

a. each rung further includes a locking aperture formed therein adjacent to the rung's at least one railing aperture, and b. the agility ladder further comprises locking members insertable into the locking apertures, whereby the railings may be situated between the locking members and the locking apertures so that insertion of the locking members within the locking apertures affixes the railings to the rungs.

24. The agility ladder of claim 17 wherein the railings extend between opposing railing ends having fasteners thereupon, whereby multiple agility ladders may be combined by attaching their railings together at the fasteners.

25. The agility ladder of claim 17 wherein the railings include multiple fasteners spaced along their lengths.

26. The agility ladder of claim 16 wherein each each rung has a handle aperture defined therein, whereby an elongated handle may be inserted through the handle apertures of the rungs to collect the rungs on the handle.

27. The agility ladder of claim 26 wherein each handle aperture is spaced distantly from the railings.

28. The agility ladder of claim 26 in combination with a handle having an elongated shaft configured for insertion through the handle apertures of the rungs.

29. The agility ladder of claim 28 further comprising a lock adapted to engage the handle shaft, thereby preventing rungs from sliding on the handle shaft past the lock.

30. The agility ladder of claim 28 wherein the handle includes an elongated grip section spaced from and extending substantially parallel to the handle shaft.

31. The agility ladder of claim 16 wherein the railings extend between opposing railing ends having fasteners thereupon, whereby multiple agility ladders may be combined by attaching their railings together at the fasteners.

32. The agility ladder of claim 16 wherein the railings include multiple fasteners spaced along their lengths.

33. The agility ladder of claim 1 wherein:

a. each railing is received within one or more apertures formed in each rung, whereby the rungs may be slidably relocated on the railings by moving the railings through the railing apertures;

b. each rung further includes a locking aperture formed therein adjacent to the railing apertures, and c. the agility ladder further comprises locking members insertable into the locking apertures, whereby the railings may be situated between the locking members and the locking apertures so that insertion of the locking members within the locking apertures affixes the railings to the rungs.

* * * * *

UNITED STATES PATENT AND TRADEMARK OFFICE

CERTIFICATE OF CORRECTION

PATENT NO. : 6,447,427 B1 
DATED : September 10, 2002
INVENTOR(S) : Steven S. Myrland et al.

It is certified that error appears in the above-identified patent and that said Letters Patent is hereby corrected as shown below:

Column 3,
Line 64, delete “fly” and insert -- firmly --

Column 7,
Line 17, delete “configurational” and insert -- configuration --

Signed and Sealed this

Twenty-first Day of January, 2003

JAMES E. ROGAN
*Director of the United States Patent and Trademark Office*